US008063335B2

(12) United States Patent
Grieshaber et al.

(10) Patent No.: US 8,063,335 B2
(45) Date of Patent: Nov. 22, 2011

(54) GAS EXHAUST FOR CIRCUIT BREAKER

(75) Inventors: Wolfgang Grieshaber, Lyons (FR); Victor Hermosillo, Bethel Park, PA (US); Charles R. Hilland, Mount Pleasant, PA (US); Daniel Schiffbauer, Uniontown, PA (US)

(73) Assignee: Areva T & D SA, Paris la Defense Cedex (FR)

( * ) Notice: Subject to any disclaimer, the term of this patent is extended or adjusted under 35 U.S.C. 154(b) by 580 days.

(21) Appl. No.: 11/649,397

(22) Filed: Jan. 3, 2007

(65) Prior Publication Data

US 2007/0158310 A1 Jul. 12, 2007

(30) Foreign Application Priority Data

Jan. 6, 2006 (FR) ..... 06 50056

(51) Int. Cl.
*H01H 33/91* (2006.01)

(52) U.S. Cl. ..... 218/157; 218/52; 218/59

(58) Field of Classification Search ..... 218/154, 218/157, 12–15, 34, 35, 43–46, 51–56, 57–69, 218/76, 156–158
See application file for complete search history.

(56) References Cited

U.S. PATENT DOCUMENTS

| | | | | |
|---|---|---|---|---|
| 4,471,187 | A | 9/1984 | Sturzenegger et al. | 200/148 |
| 5,159,164 | A * | 10/1992 | Koyanagi et al. | 218/62 |
| 6,515,248 | B2 * | 2/2003 | Imamura et al. | 218/59 |
| 2002/0113040 | A1 | 8/2002 | Imamura et al. | 218/43 |
| 2003/0127430 | A1 | 7/2003 | Iwabuchi et al. | 218/43 |
| 2005/0150868 | A1 * | 7/2005 | Nowakowski | 218/57 |

FOREIGN PATENT DOCUMENTS

| | | |
|---|---|---|
| FR | 2760890 | 9/1998 |
| JP | 01134829 | 5/1989 |
| WO | 03/096366 A1 | 11/2003 |

* cited by examiner

*Primary Examiner* — R S Luebke
*Assistant Examiner* — Marina Fishman
(74) *Attorney, Agent, or Firm* — Nixon Peabody LLP

(57) ABSTRACT

The gas exhaust comprises a generally cylindrical shaped casing closed by a bottom at one end and with openings to allow gas to escape. A duct is arranged in the casing to delimit a central passage inside the duct, and an annular passage surrounding the central passage outside the duct between it and the casing. There is a communication consisting of four holes in the duct close to the bottom to form a communication between the central passage inside the duct and the annular passage. The casing includes two diametrically opposite openings located in a horizontal plane.

5 Claims, 6 Drawing Sheets

GAS EXHAUST FOR CIRCUIT BREAKER

CROSS REFERENCE TO RELATED APPLICATIONS OR PRIORITY CLAIM

This application claims priority of the French Patent Application No. 06 50056 filed Jan. 6, 2006.

TECHNICAL DOMAIN

This invention relates to a gas exhaust for a circuit breaker, comprising a generally cylindrical shaped casing closed by a bottom at one end and with openings to allow gas to escape, a duct arranged in the casing to delimit a central passage inside the duct, and an annular passage surrounding the central passage outside the duct between it and the casing, a communication being provided in the duct close to the bottom to form a communication between the central passage inside the duct and the annular passage.

An electrical device with a gas exhaust of this type is already known (WO 03/096366) (see FIG. 7). The electrical device has a breaking zone in which a gas is generated by an arc in a nozzle. This gas flows through a channel into a cooling device in the shape of a cooling tube. This tube has a thick wall in which many through orifices are provided to allow gas to pass through. A device of this type leads to poor use of the volume enclosed in the exhaust that hot gases generated by the break must flush out before reaching the exit from the exhaust that contains sharp edges that lead to increases in the field such that an arc could be initiated from these edges towards the metal tank in which the electrical device is housed.

Furthermore, dust and particles collect at the bottom of the tank and they may include electrically conducting particles. The electric field existing between the outside surface of the exhaust and the inside surface of the tank is sometimes sufficient to make these conducting particles move or even to orient them vertically. Once these conducting particles are oriented vertically, they can have tip effects. This tip effect facilitates initiation of arcs between the exhaust from the live equipment and the metal tank connected to the ground. The cooling tube perforated with orifices is an axisymmetric part such that gases are blown in all directions, particularly upwards and downwards. As soon as the gas has been generated, it blows into this cluster of particles that starts to swirl. This facilitates straightening of conducting particles and therefore arc initiation.

Before the exhaust is completely full of hot gas, some of this gas escapes and creates a path towards the tank. Since hot gas is a much better conductor than cold gas, the result can be late arcs formed between the exhaust and the tank if the quantity of hot gas leading the exhaust is significant.

Furthermore, the part of the cooling tube perforated with orifices through which hot gases can pass is long in the axial direction.

It extends from marks 114*a* to 115. Therefore there are two paths towards the exit from the exhaust that are significantly different in length. Gas always starts from mark 108 and ends up at mark 112, and gas passing through the cooling tube to mark 114*a* reaches the exit 112 after travelling along a significantly shorter path. This significantly short path causes the total volume of gas contained in the exhaust to increase. Therefore, it is close to the mark 115 of the cold gas that is not pushed outside the exhaust until later.

The purpose of the invention is an exhaust that overcomes these disadvantages. According to the invention, these purposes are achieved by the fact that the casing includes two diametrically opposite openings located in a horizontal plane.

Due to this characteristic, the exhaust does not include a large number of small orifices with a resistance to gas flow as in prior art, but instead has large diameter openings for which the radii of curvature may be made sufficiently large to prevent the appearance of an increase in the electric field. The radii of curvature are compatible with easy exhaust of gas and electrical withstand of the nearby tank. Furthermore, since the openings are in a horizontal plane, the heavy dust particles and the particles of derived products caused by interruption of the current are not blown into an area in the tank in which other particles have already accumulated.

According to the invention, particles are not expelled outside the exhaust because the gas changes direction several times before reaching the exit from the exhaust. At each turning point, centrifugal forces act on heavy particles to separate them from the main current, like in a cyclone.

Preferably, the passage cross-section available to the gas is monotonous and progressively increasing.

Due to this characteristic, the available passage cross-section for the gas flow increases monotonously from the nozzle up to a maximum value. This avoids vortices that create an unwanted back pressure and reduce breaking performances, and also reduce cold gas pockets, in other words part of the volume of the exhaust that does not contain hot gas.

The hot gas is slowed down and particles are allowed to remain partly in the exhaust, some of these particles being conducting.

Preferably, the cross-section passage available to the gas does not vary by a factor of more than four at each increase in cross-section.

In one preferred embodiment, the two openings formed in the casing are spaced at a given distance from a bottom of the annular passage and four radial partitions are provided firstly to provide a surround around the openings formed in the casing, and secondly to delimit isolated gas passages from openings so as to force the gas to travel as far as the bottom of the annular passage before it can escape through the openings.

Due to this characteristic, gas follows two different paths to exit from the exhaust. Gas currents scavenge the entire inside volume of the exhaust and this prevents any cold gas pockets from remaining in the device.

Preferably, the openings formed in the casing extend around about a third of the periphery of the casing.

In one particular embodiment, the communication provided in the duct close to the bottom to create a communication between the central passage in the duct and the annular passage consists of four holes.

Other specific features and advantages of the invention will become clearer after reading the following description of an example embodiment given for illustrative purposes with reference to the appended drawings wherein.

Figure 1:
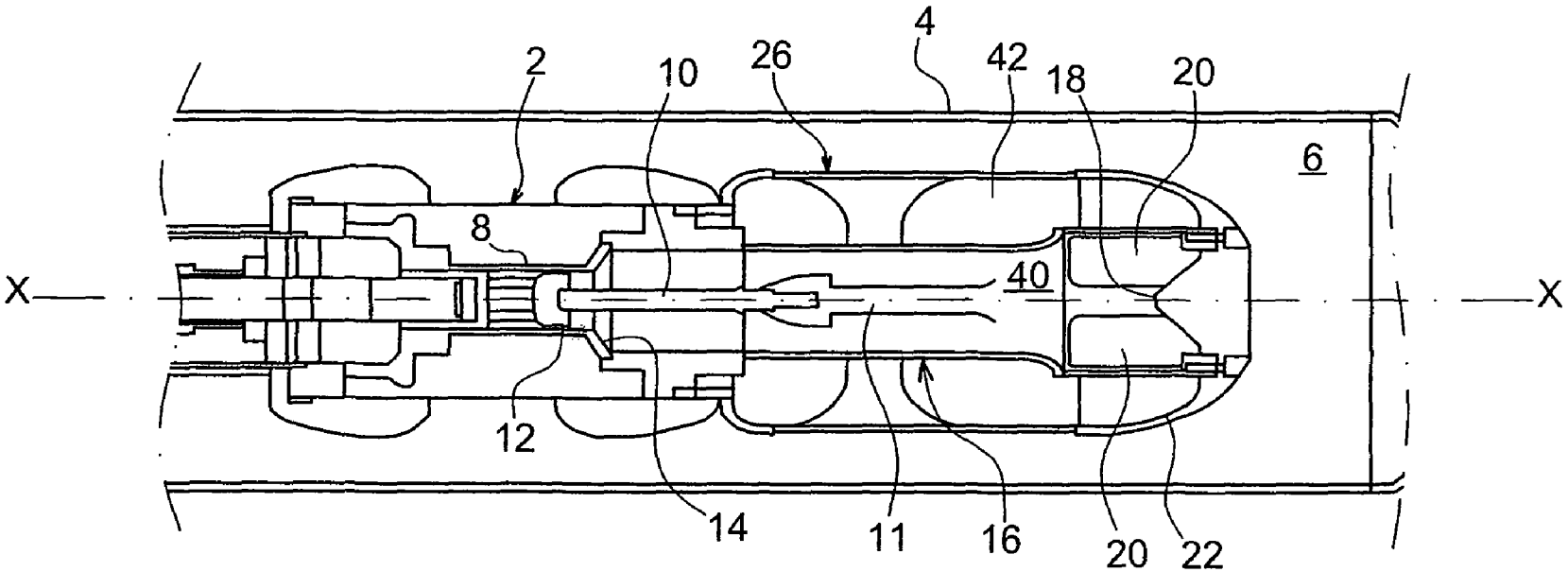
FIG. 1 shows a sectional elevation view of a circuit breaker comprising a gas exhaust according to this invention.
Figure 2:
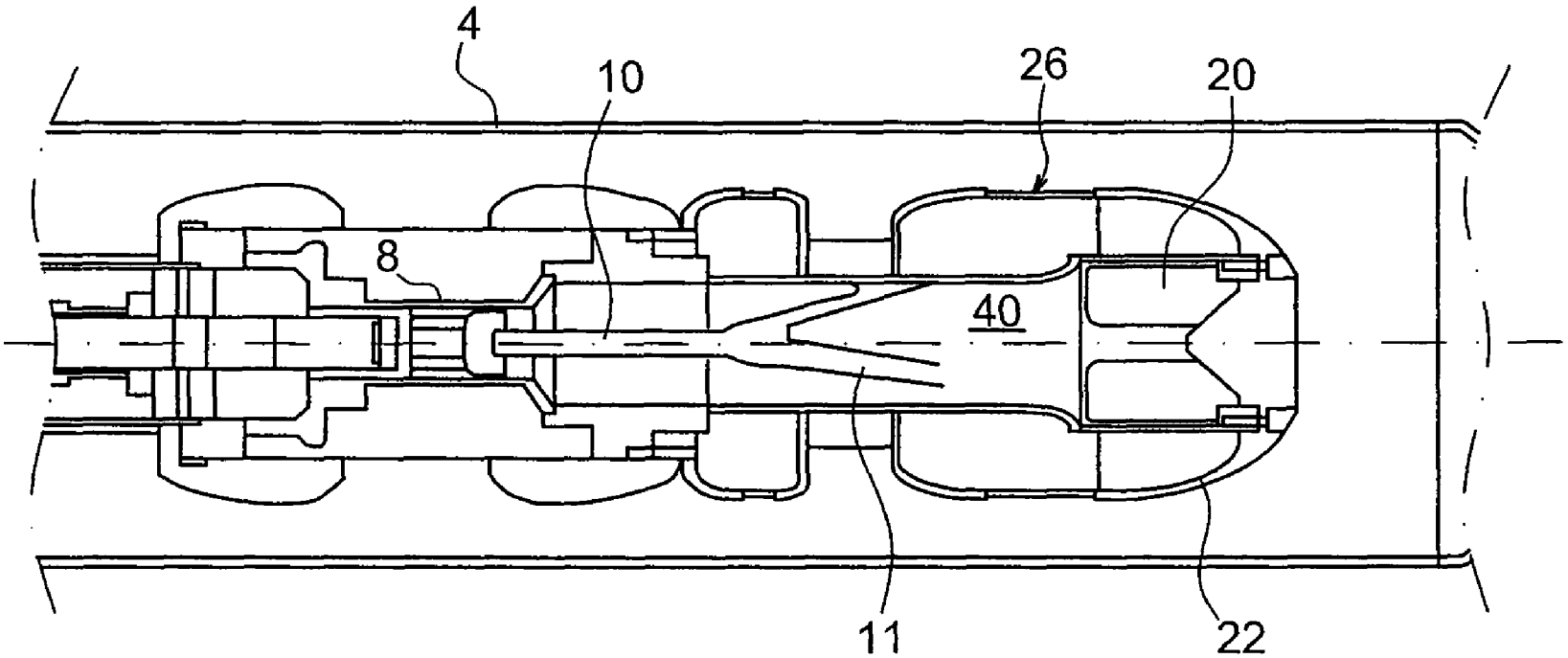
FIG. 2 shows a horizontal sectional view of the circuit breaker in FIG. 1.

FIGS. 1 and 2 diagrammatically show an electrical breaking device such as a circuit breaker.

The electrical equipment is housed in a tank 4 filled with an insulating gas 6, for example such as $SF_6$. The circuit breaker is provided with a mobile arc contact 8 and a fixed arc contact 10 installed on three stands 11. During a break, an arc develops between the mobile contact 8 and the fixed contact 10. This is why the space located between the fixed contact and the mobile contact is surrounded by an insulating nozzle 12 with a flared end 14. The function of the nozzle 12 is to direct the gas or plasma generated by the electrical arc between the fixed contact and the mobile contact. The fixed contact 10 is surrounded by a duct 16 in which the flared part 14 of the nozzle 12 slides like a piston. One end of the duct 16 is closed by a bottom composed of a dome 18. The duct is perforated by four orifices 20 with an approximately rectangular cross-section, near the dome 18. A rounded shell 22 with a large radius of curvature and with a shape similar to an egg is located outside the dome 18.

Figure 3:
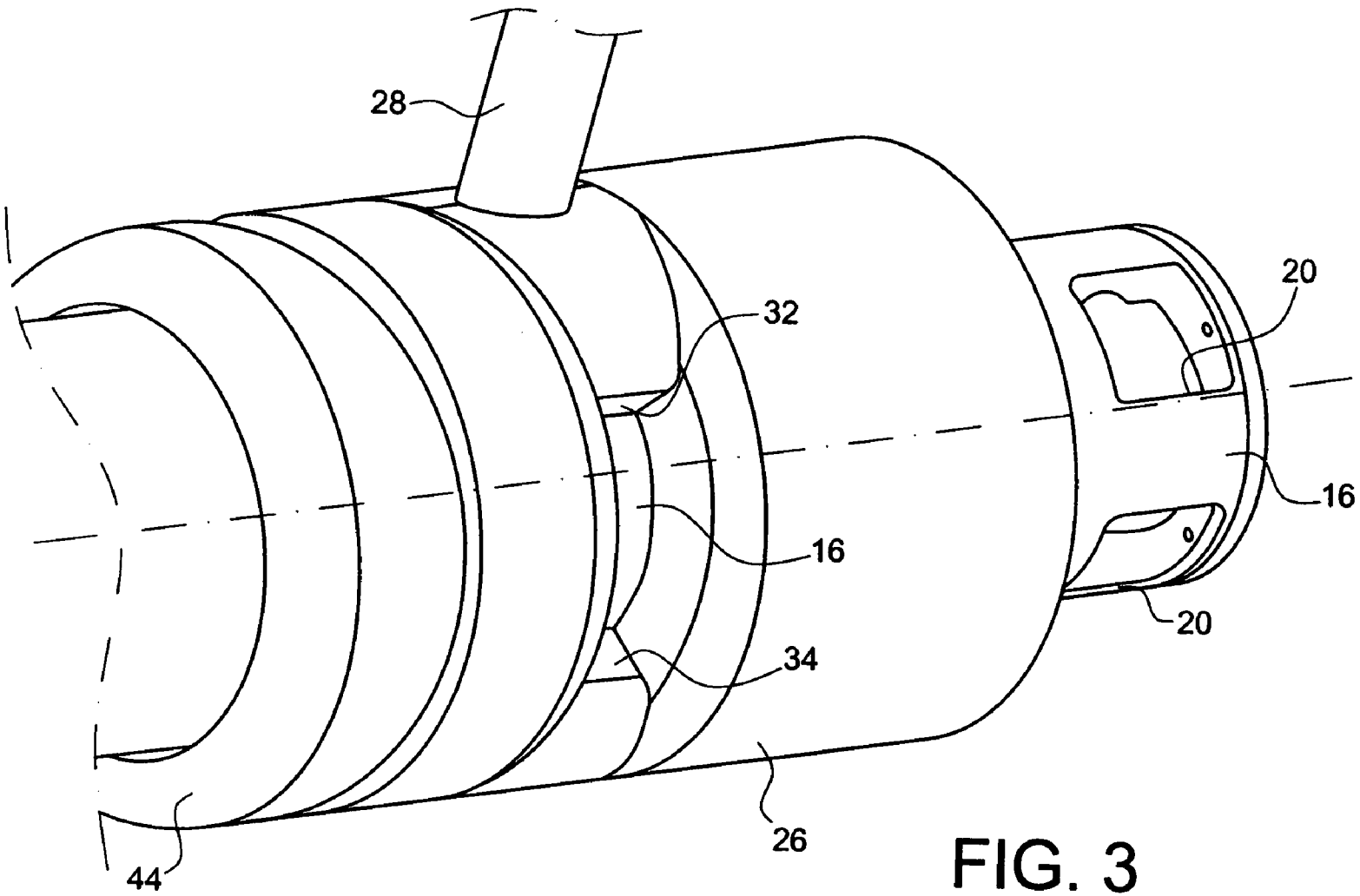
FIG. 3 shows a larger scale perspective view of part of the exhaust according to the invention.
Figure 5:
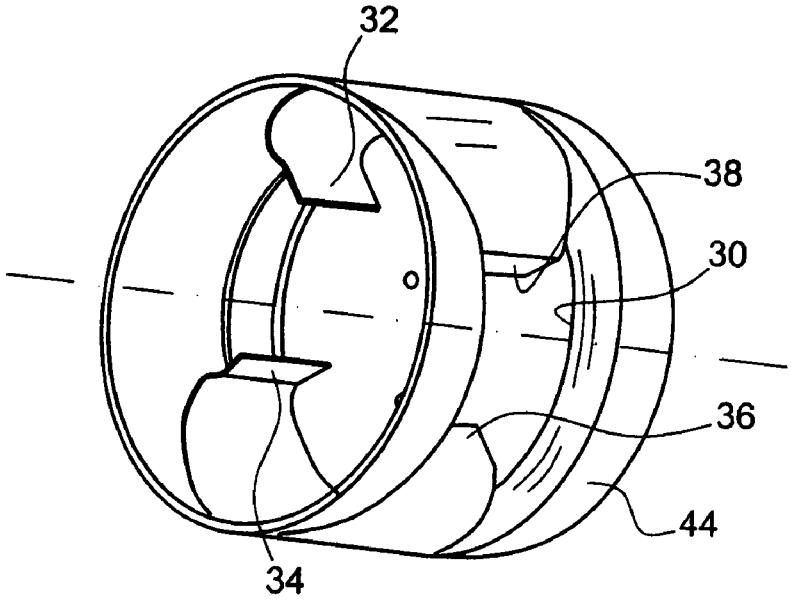
Figure 6:
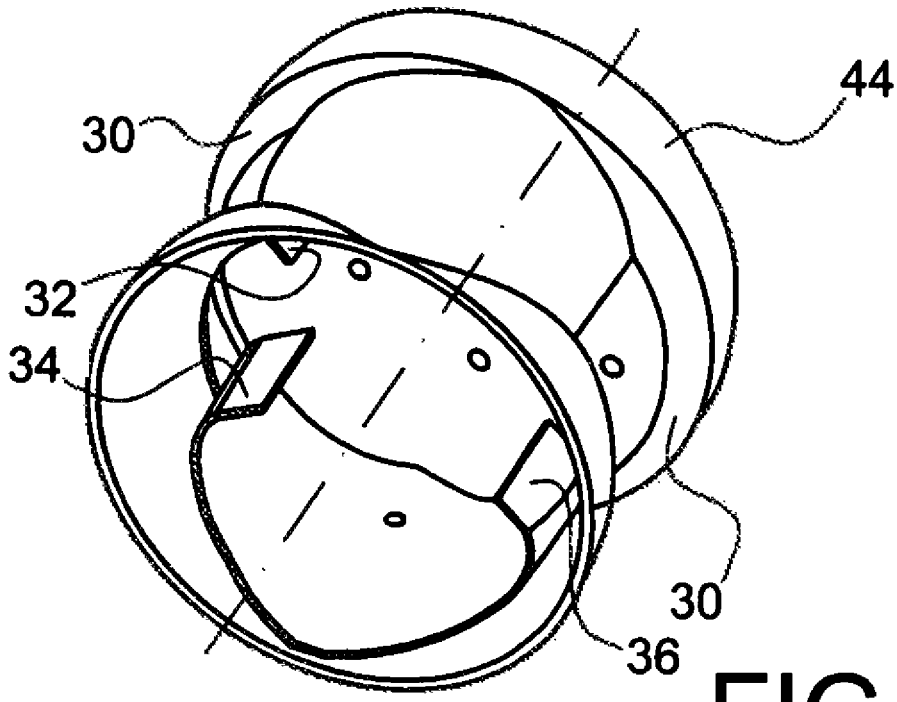
Figure 7:
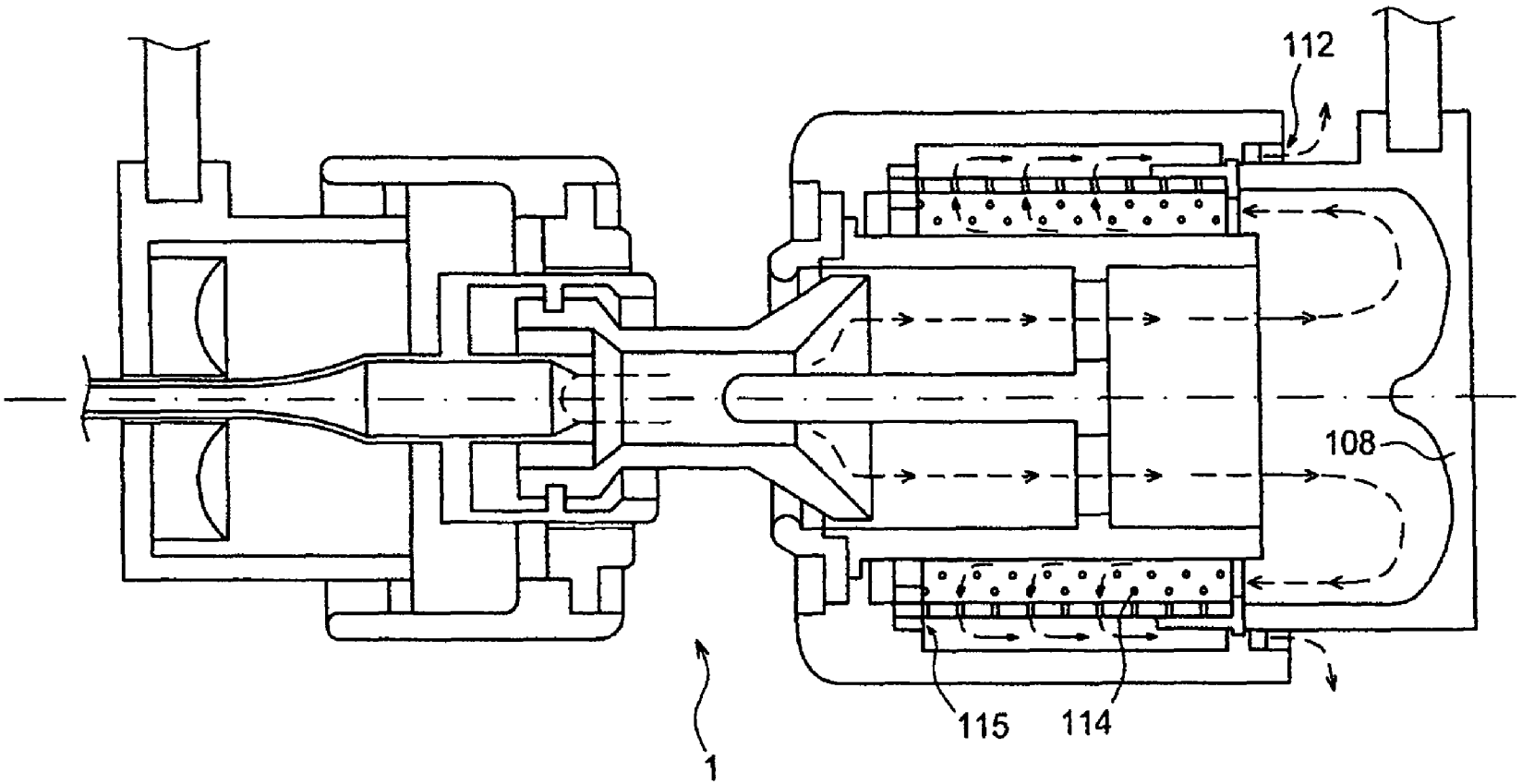
FIG. 7 (PRIOR ART)
FIG. 7 shows a sectional view of a circuit breaker according to prior art.

On the outside, the duct is surrounded by a casing 26 shown in a perspective view in FIG. 3. The right end of the duct 16 comprising the four passage holes 20 (with the shell 22 being removed) can be seen in the right part of the figure starting from the casing 26. The shape of the casing 26 is cylindrical and it is coaxial with the XX axis of the circuit breaker. An electric conductor 28 is connected to the circuit breaker near its upper part. Two openings 30 in the horizontal direction are formed in the casing 26 (only one opening is shown in FIG. 3). The openings 30 were made by forming two radial partitions 32, 34, 36, 38 for each opening 30 (see FIGS. 5 and 6). Each partition is directed radially inwards and extends as far as the outer peripheral surface of the duct 16, in which a part can be observed through the opening 13 shown in FIG. 3.

Figure 4:
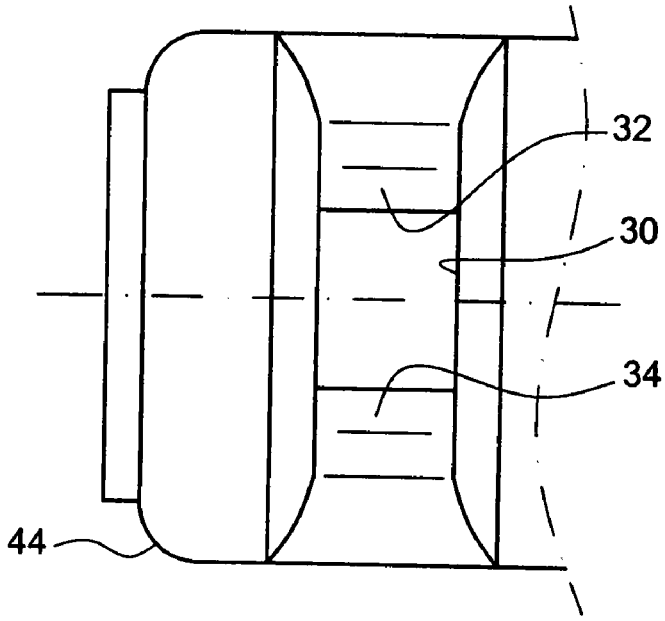
FIGS. 4, 5 and 6 show detailed views that show openings formed in the casing and the shape of the radial partitions.

On the inside, the duct delimits a central passage 40 and on the outside it delimits an annular passage 42 between it and the casing 26. The central passage 40 and the annular passage 42 communicate with each other through four holes 20 formed at the end of the duct near the dome 18. The result is a labyrinth path that, as described above, advantageously enables deposition of heavy particles in suspension in the gas current, and also creates a monotonously increasing section so as to avoid trapping cold gas pockets in the exhaust, particularly in the central passage 40. As can be seen particularly in FIG. 4, the annular passage 42 is split into two parts by two pairs of radial partitions, firstly 32 and 34 and secondly 36 and 38. Part of this annular duct communicates directly with the openings 30 such that gas can escape directly. Two gas passages isolated from the openings 30 are formed firstly by part of the annular passage between radial partitions 32 and 38, and secondly part of the passage between the partitions 34 and 36, so as to constrain the part of the gas passing through these passages to go as far as a bottom 44 of the annular passage opposite the shell 22. Preferably, the passage cross-section of the holes 30 is about one third of the cross-section of the isolated channels located between firstly radial partitions 32 and 38 and secondly radial partitions 34 and 36. In other words, the passage cross-section of the isolated channels is approximately twice as large as the passage cross-section of the exit orifices 30.

Due to these shapes, the passage cross-section available to the gas increases monotonously. The cross-section of the annular channel 42 is significantly greater than the cross-section of the central passage 40. Furthermore, radii of curvature at all points along the path are large, which facilitates gas circulation. Radial partitions 32 themselves are provided with large radii of curvature compared with the external peripheral surface of the casing 26 such that there is no electric field concentration at any point.

This device operates as follows. When a break occurs, an arc is set up between the mobile contact 8 and the fixed contact 10. A quantity of hot gas is generated and propagates from the nozzle 12 in the duct 16 that it follows along its entire length until it reaches the dome 18 on which it becomes oriented perpendicularly so as to pass through the orifices 20. The gas jet then strikes the rounded parts of the shell 22 creating a first direction change. The gas then travels along the annular passage 42. Part of the gas escapes directly through the orifices 30 while the remaining part of the gas flows as far as the bottom 44 where it is subjected to a second direction change. Gas then returns towards the orifices 30 passing above the radial partitions 32, 34, 36, 38 and goes out through the openings 30.

What is claimed is:

1. A gas exhaust arrangement for a circuit breaker, comprising:

a generally cylindrical shaped casing closed by a bottom at one end and with openings to allow gas to escape;

a stationary duct arranged in the casing to delimit a central passage inside the duct; and an annular passage surrounding the central passage, the annular passage located between the duct and the casing, four apertures being provided in the duct exclusively proximal to the bottom to form a permanent communication between the central passage inside the duct and the annular passage, wherein the casing includes two diametrically opposite openings located in a horizontal plane and wherein a cross section of the permanent communication is greater than a cross section of the central passage, wherein a cross section of the annular passage is greater than cross section of the apertures and wherein the two openings formed in the casing are spaced by a distance from a bottom of the annular passage, and wherein the annular passage is split into two parts by two pairs of radial partitions so that a part of the annular passage communicates directly with the two openings, the gas escaping directly, and another part of the passage is isolated from the two opening, to force the gas to travel as far as the bottom of the annular passage before escaping through the two openings.

2. The gas exhaust arrangement according to claim 1, characterized in that the cross-section passage available to the gas does not vary by a factor of more than four at each increase in cross-section.

3. The gas exhaust arrangement according to claim 1, characterized in that the openings formed in the casing extend around about a third of the periphery of the casing.

4. A gas exhaust arrangement for a circuit breaker, comprising a generally cylindrical shaped casing having a first end and a second end, the second end being closed by a bottom, the casing including a plurality of diametrically opposite openings located therethrough;

a stationary duct arranged within the casing, the duct includes a hole proximal to the second end;

a central passage inside the duct and in communication with the hole;

an annular passage positioned between the duct and the casing, wherein the annular passage is in communication with the hole and the openings in the casing, wherein a cross section of the annular passage is greater than a cross section of the hole and wherein a cross section of the plurality of diametrically opposite openings is greater than a cross section of the central passage.

5. The gas exhaust arrangement of claim 4, wherein the annular passage allows gas to pass from the central passage through the hole into the annular passage and out of the casing through the openings.

* * * * *